US012264842B2

(12) United States Patent
Atchison

(10) Patent No.: US 12,264,842 B2
(45) Date of Patent: Apr. 1, 2025

(54) INTEGRATED ZONE CONTROL SYSTEM

(71) Applicant: Johnson Controls Tyco IP Holdings LLP, Milwaukee, WI (US)

(72) Inventor: Shaun B. Atchison, Wichita, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 17/403,543

(22) Filed: Aug. 16, 2021

(65) Prior Publication Data

US 2021/0372636 A1 Dec. 2, 2021

Related U.S. Application Data

(63) Continuation of application No. 16/253,070, filed on Jan. 21, 2019, now Pat. No. 11,092,346.

(Continued)

(51) Int. Cl.
*F24F 3/044* (2006.01)
*F24F 11/30* (2018.01)

(Continued)

(52) U.S. Cl.
CPC ..... *F24F 3/044* (2013.01); *F24F 11/30* (2018.01); *F24F 11/54* (2018.01); *F24F 11/58* (2018.01);

(Continued)

(58) Field of Classification Search
CPC .. F24F 3/044; F24F 11/80; F24F 11/63; F24F 11/755; F24F 11/30; F24F 11/54;

(Continued)

(56) References Cited

U.S. PATENT DOCUMENTS 4,969,508 A * 11/1990 Tate ..... F24F 11/523 236/51
6,983,889 B2 * 1/2006 Alles ..... F24F 3/0442 62/186

(Continued)

FOREIGN PATENT DOCUMENTS

CA 2957726 A1 3/2016
CA 3043996 A1 2/2018

(Continued)

OTHER PUBLICATIONS

Coolinglogic, "CoolingLogic: Up early, saving billions." URL: http://coolinglogic.com/documents/MarketingFlyer_FINAL_HiRes8.5x11.pdf, retrieved from internet Oct. 27, 2022 (1 page).

(Continued)

*Primary Examiner* — Claire E Rojohn, III
(74) *Attorney, Agent, or Firm* — Fletcher Yoder, P.C.

(57) ABSTRACT

A zoning system for a heating, ventilation, and/or air conditioning (HVAC) system includes a temperature control device configured to monitor a temperature in a zone of a structure for conditioning by the HVAC system and configured to send a wireless control signal including data based on the temperature, and a damper actuator configured to be associated with the zone and configured to adjust a position of a damper to control an airflow into the zone, where the damper actuator is configured to receive the wireless control signal from the temperature control device and configured to adjust the position of the damper based on the data.

10 Claims, 8 Drawing Sheets

Related U.S. Application Data

(60) Provisional application No. 62/789,852, filed on Jan. 8, 2019.

(51) Int. Cl.

| | |
|---|---|
| ***F24F 11/54*** | (2018.01) |
| ***F24F 11/58*** | (2018.01) |
| ***F24F 11/63*** | (2018.01) |
| ***F24F 11/755*** | (2018.01) |
| ***F24F 11/79*** | (2018.01) |
| ***F24F 11/80*** | (2018.01) |
| ***F24F 13/10*** | (2006.01) |
| ***F24F 110/10*** | (2018.01) |
| ***F24F 120/12*** | (2018.01) |
| ***F24F 140/40*** | (2018.01) |
| ***F24F 140/50*** | (2018.01) |

(52) U.S. Cl.
CPC ..... *F24F 11/63* (2018.01); *F24F 11/755* (2018.01); *F24F 11/79* (2018.01); *F24F 11/80* (2018.01); *F24F 13/10* (2013.01); *F24F 2003/0446* (2013.01); *F24F 2110/10* (2018.01); *F24F 2120/12* (2018.01); *F24F 2140/40* (2018.01); *F24F 2140/50* (2018.01)

(58) Field of Classification Search
CPC .. F24F 11/58; F24F 11/79; F24F 13/10; F24F 2140/40; F24F 2140/50; F24F 2120/12; F24F 2110/10; F24F 2003/0446
USPC ..... 165/217
See application file for complete search history.

(56) References Cited

U.S. PATENT DOCUMENTS 6,986,469 B2 * 1/2006 Gauthier ..... G05D 23/1919 236/46 F
7,055,759 B2 * 6/2006 Wacker ..... F24F 11/56 236/94
7,063,140 B1 * 6/2006 Woo ..... F24F 11/76 236/1 C
7,130,720 B2 * 10/2006 Fisher ..... F24F 11/62 700/277
7,156,316 B2 * 1/2007 Kates ..... G05D 23/1934 165/208
7,163,156 B2 * 1/2007 Kates ..... F24F 11/62 700/277
7,222,494 B2 * 5/2007 Peterson ..... F24F 11/70 62/158
7,222,800 B2 * 5/2007 Wruck ..... F24F 11/30 236/94
7,261,241 B2 * 8/2007 Eoga ..... G05D 23/1919 165/247
7,344,089 B1 3/2008 Sutterfield
7,354,005 B2 4/2008 Carey et al.
7,392,661 B2 * 7/2008 Alles ..... F24F 13/10 236/94
7,548,833 B2 * 6/2009 Ahmed ..... F24F 11/58 702/188
7,606,635 B2 10/2009 Fisher
7,693,591 B2 * 4/2010 Hoglund ..... F24F 11/49 700/277
7,726,582 B2 * 6/2010 Federspiel ..... F24F 11/30 700/277
7,809,472 B1 * 10/2010 Silva ..... F24F 11/62 236/1 C
7,832,465 B2 11/2010 Zou et al.
7,880,421 B2 * 2/2011 Karwath ..... F04D 27/004 318/644
7,904,209 B2 * 3/2011 Podgorny ..... F24F 11/58 700/277
7,957,839 B2 * 6/2011 Takach ..... F24F 11/30 700/83
7,983,796 B2 * 7/2011 Kassel ..... F24F 11/46 700/278
8,010,237 B2 * 8/2011 Cheung ..... G05B 19/048 165/238
8,014,902 B2 * 9/2011 Kates ..... H02J 3/14 700/282
8,020,777 B2 * 9/2011 Kates ..... F24F 11/62 165/208
8,038,075 B1 * 10/2011 Walsh ..... F24F 13/1426 236/51
8,078,325 B2 * 12/2011 Poth ..... F24F 11/52 700/237
8,086,352 B1 * 12/2011 Elliott ..... G05D 23/1934 700/282
8,090,477 B1 * 1/2012 Steinberg ..... G05D 23/1905 700/278
8,112,181 B2 * 2/2012 Remsburg ..... F24F 11/52 700/277
8,116,913 B2 * 2/2012 Mirpourian ..... F25B 9/004 700/278
8,143,828 B2 * 3/2012 Becerra ..... G05D 23/19 318/471
8,147,302 B2 * 4/2012 Desrochers ..... F24F 11/46 702/50
8,190,301 B2 * 5/2012 Voysey ..... G05B 19/401 700/275
8,209,059 B2 * 6/2012 Stockton ..... G05D 22/02 165/223
8,219,252 B2 * 7/2012 Nanami ..... F24F 11/64 700/277
8,224,490 B2 * 7/2012 Knyazev ..... F24F 11/52 700/277
8,229,596 B2 * 7/2012 Mejias ..... H04L 69/08 700/79
8,350,691 B2 1/2013 McFarland
8,369,995 B2 * 2/2013 Nanami ..... G05B 19/042 700/277
8,397,527 B2 * 3/2013 Miller ..... G05B 15/02 454/239
8,417,386 B2 * 4/2013 Douglas ..... F24F 11/52 62/115
8,418,128 B2 * 4/2013 Pouchak ..... F24F 11/88 717/109
8,495,888 B2 * 7/2013 Seem ..... F24F 11/30 62/186
8,515,584 B2 * 8/2013 Miller ..... F24F 11/30 236/44 C
8,543,244 B2 * 9/2013 Keeling ..... F24F 11/63 700/297
8,579,205 B2 * 11/2013 Augusto ..... F24F 11/74 700/277
8,651,391 B2 * 2/2014 Patch ..... F24F 11/46 62/186
8,660,708 B2 * 2/2014 Narayanamurthy ..... G05D 23/1924 700/299
8,661,165 B2 * 2/2014 Grohman ..... F24F 11/30 710/10
8,702,482 B2 * 4/2014 Helt ..... F24F 11/75 454/229
8,963,728 B2 * 2/2015 Kates ..... G08B 17/11 340/627
9,103,555 B2 8/2015 Zou et al.
9,183,733 B2 * 11/2015 Kates ..... G08B 21/182
9,328,936 B2 * 5/2016 Meirav ..... F24F 11/81
9,441,847 B2 * 9/2016 Grohman ..... F24F 11/46
9,447,985 B2 9/2016 Johnson
9,513,186 B2 * 12/2016 Buseyne ..... G01M 3/2815
9,553,451 B2 1/2017 Zacharchuk et al.
9,621,371 B2 4/2017 Reeder et al.
9,638,436 B2 * 5/2017 Arensmeier ..... G05B 15/02
9,845,965 B2 * 12/2017 Lehnert ..... F24F 11/62
9,872,126 B2 * 1/2018 Yarde ..... G05B 19/042
9,971,364 B2 5/2018 Zywicki et al.

(56) References Cited

U.S. PATENT DOCUMENTS

| | | | | |
|---|---|---|---|---|
| 10,129,383 | B2 | 11/2018 | Imes et al. | |
| 10,190,794 | B1 | 1/2019 | Zelczer et al. | |
| 10,260,765 | B2 | 4/2019 | Zakaria | |
| 10,444,781 | B2 | 10/2019 | Imes et al. | |
| 10,533,761 | B2 * | 1/2020 | Barton | F24F 11/38 |
| 10,871,756 | B2 | 12/2020 | Johnson et al. | |
| 10,908,578 | B2 | 2/2021 | Johnson et al. | |
| 10,921,768 | B2 | 2/2021 | Johnson et al. | |
| 11,156,978 | B2 | 10/2021 | Johnson et al. | |
| 2001/0048030 | A1 | 12/2001 | Sharood et al. | |
| 2010/0006660 | A1 | 1/2010 | Leen et al. | |
| 2013/0068846 | A1 | 3/2013 | Bluestone | |
| 2013/0158718 | A1 * | 6/2013 | Barton | F24F 11/30 700/276 |
| 2014/0031988 | A1 | 1/2014 | Reeder et al. | |
| 2015/0028113 | A1 | 1/2015 | Day | |
| 2015/0195099 | A1 | 7/2015 | Imes et al. | |
| 2015/0369507 | A1 | 12/2015 | Flaherty et al. | |
| 2016/0258638 | A1 | 9/2016 | Waseen et al. | |
| 2016/0357199 | A1 | 12/2016 | Matlock | |
| 2017/0074536 | A1 | 3/2017 | Bentz et al. | |
| 2017/0089599 | A1 | 3/2017 | Hale | |
| 2017/0089603 | A1 | 3/2017 | Bentz et al. | |
| 2017/0130981 | A1 * | 5/2017 | Willette | F24F 11/30 |
| 2017/0234562 | A1 * | 8/2017 | Ribbich | F24F 11/86 700/277 |
| 2018/0031253 | A1 | 2/2018 | McCune et al. | |
| 2018/0031256 | A1 | 2/2018 | Gillette et al. | |
| 2018/0031258 | A1 | 2/2018 | Hern et al. | |
| 2018/0031261 | A1 | 2/2018 | Bentz et al. | |
| 2018/0031262 | A1 | 2/2018 | Atchison et al. | |
| 2018/0031264 | A1 | 2/2018 | Atchison et al. | |
| 2018/0031266 | A1 | 2/2018 | Atchison et al. | |
| 2018/0031267 | A1 | 2/2018 | Hern et al. | |
| 2018/0031289 | A1 | 2/2018 | Hern et al. | |
| 2018/0032969 | A1 | 2/2018 | Gillette et al. | |
| 2018/0121190 | A1 | 5/2018 | Atchison et al. | |
| 2018/0266718 | A1 | 9/2018 | Gillette et al. | |
| 2018/0267794 | A1 | 9/2018 | Atchison et al. | |
| 2019/0145649 | A1 | 5/2019 | Atchison et al. | |
| 2019/0154298 | A1 | 5/2019 | Zelczer et al. | |
| 2019/0264934 | A1 | 8/2019 | Atchison et al. | |
| 2019/0264937 | A1 | 8/2019 | Atchison et al. | |
| 2019/0264939 | A1 | 8/2019 | Atchison et al. | |
| 2019/0265662 | A1 | 8/2019 | Atchison et al. | |
| 2019/0310831 | A1 | 10/2019 | Gillette et al. | |
| 2019/0323823 | A1 | 10/2019 | Atchison et al. | |
| 2019/0353367 | A1 | 11/2019 | Atchison | |
| 2019/0353372 | A1 | 11/2019 | Rigg et al. | |
| 2019/0353373 | A1 | 11/2019 | Atchison | |
| 2019/0353381 | A1 | 11/2019 | Atchison et al. | |
| 2019/0353382 | A1 | 11/2019 | Atchison et al. | |
| 2019/0353388 | A1 | 11/2019 | Burns et al. | |
| 2019/0353392 | A1 | 11/2019 | Atchison | |
| 2020/0003467 | A1 | 1/2020 | Noor et al. | |
| 2020/0166228 | A1 | 5/2020 | Gillette et al. | |
| 2020/0166229 | A1 | 5/2020 | Bentz et al. | |
| 2020/0217524 | A1 | 7/2020 | Atchison | |
| 2020/0217550 | A1 | 7/2020 | Boyd et al. | |
| 2020/0284463 | A1 | 9/2020 | Atchison et al. | |
| 2021/0285680 | A1 * | 9/2021 | Atchison | F24F 11/32 |
| 2021/0287311 | A1 * | 9/2021 | Bentz | G06Q 20/145 |
| 2021/0293435 | A1 * | 9/2021 | Atchison | F24F 13/10 |
| 2021/0302039 | A1 * | 9/2021 | Atchison | F24F 11/52 |
| 2022/0082286 | A1 * | 3/2022 | Atchison | F24F 11/64 |
| 2022/0178566 | A1 * | 6/2022 | Wallace | F24F 11/84 |
| 2023/0090958 | A1 * | 3/2023 | Atchison | F24F 11/52 700/278 |
| 2023/0205159 | A1 * | 6/2023 | Mills | G05B 19/042 700/276 |

FOREIGN PATENT DOCUMENTS

| | | | |
|---|---|---|---|
| EP | 3 186 687 | A4 | 7/2017 |
| EP | 3 497 377 | A1 | 6/2019 |
| WO | 2018164682 | A1 | 9/2018 |
| WO | 2019199287 | A1 | 10/2019 |

OTHER PUBLICATIONS

Incomplete File of Communication with Various Companies, etc. in 2016-2021, URL: http://coolinglogic.com/documents/22072101_Letters_and_Signature_Receipts.pdf, published, as one document, on: Jul. 21, 2022 (211 pages).

Johnson Heating and Cooling L.L.C., "Divine Grace Building Automation (Images)," URL: http://cooljohnson.com/Building-Automation-Systems-Michigan/Oakland-County-Michigan/Building-Automation-Images.html, retrieved from internet Oct. 27, 2022 (8 pages).

Johnson Heating and Cooling L.L.C., "Divine Grace Building Automation," URL: http://cooljohnson.com/Building-Automation-Systems-Michigan/Oakland-County-Michigan/Building-Automation-Divine-Grace.html, retrieved from internet Oct. 27, 2022 (3 pages).

Johnson Heating and Cooling L.L.C., "Excel Rehabilitation Building Automation," URL: http://cooljohnson.com/Building-Automation-Systems-Michigan/Waterford-Michigan/Building-Automation-System--Excel.html, retrieved from internet Oct. 27, 2022 (2 pages).

Johnson Heating and Cooling L.L.C., "Intertek Testing Services Building Automation," URL: http://cooljohnson.com/Building-Automation-Systems-Michigan/Plymouth-Michigan/Building-Automation-System-Plymouth-Michigan.html, retrieved from internet Oct. 27, 2022 (8 pages).

Johnson Heating and Cooling L.L.C., "JLA Medical Building Building Automation," URL: http://cooljohnson.com/Building-Automation-Systems-Michigan/Waterford-Michigan/Building-Automation-System--JLA.html, retrieved from internet Oct. 27, 2022 (3 pages).

Johnson Heating and Cooling L.L.C., "Mosaic Christian Building Automation (Images)," URL: http://cooljohnson.com/Building-Automation-Systems-Michigan/Detroit/Building-Automation-Images.html, retrieved from internet Oct. 27, 2022 (12 pages).

Johnson Heating and Cooling L.L.C., "Mosaic Christian Building Automation," URL: http://cooljohnson.com/Building-Automation-Systems-Michigan/Detroit/Mosaic-Christian.html, retrieved from internet Oct. 27, 2022 (5 pages).

Johnson Heating and Cooling L.L.C., "Shepherd's Gate Lutheran Church Building Automation," URL: http://cooljohnson.com/Building-Automation-Systems-Michigan/Shelby-Township-Michigan/Building-Automation-Systems-SG.html, retrieved from internet Oct. 27, 2022 (3 pages).

Johnson Heating and Cooling L.L.C., "St. Clair County Residence Building Automation," URL: http://cooljohnson.com/Building-Automation-Systems-Michigan/St-Clair-Michigan/Building-Automation-System-St-Clair-Michigan.html, retrieved from internet Oct. 27, 2022 (4 pages).

Johnson Heating and Cooling L.L.C., "St. Joseph Mercy Oakland U. C. Building Automation," URL: http://cooljohnson.com/Building-Automation-Systems-Michigan/Waterford-Michigan/Building-Automation-Systems-SJMO.html, retrieved from internet Oct. 27, 2022 (2 pages).

Johnson Heating and Cooling L.L.C., "Waterford Internal Medicine Building Automation," URL: http://cooljohnson.com/Building-Automation-Systems-Michigan/Waterford-Michigan/Building-Automation-Systems-WIM.html, retrieved from internet Oct. 27, 2022 (3 pages).

Johnson Heating and Cooling, LLC, "Building Automation Clawson Michigan 2.0," URL: http://cooljohnson.com/Building-Automation-Systems-Michigan/Clawson-Michigan/Building-Automation-Clawson-Manor-2.html, retrieved from the internet Oct. 27, 2022 (6 pages).

Johnson Heating and Cooling, LLC, "Building Automation Images Clawson Michigan 2.0," URL: http://cooljohnson.com/Building-

(56) References Cited

OTHER PUBLICATIONS

Automation-Systems-Michigan/Clawson-Michigan/Building-Automation-Clawson-Manor-2-Images.html, retrieved from the internet Oct. 27, 2022 (14 pages).
Johnson Heating and Cooling, LLC, "Building Automation System Clawson Michigan Clawson Manor," URL: http://cooljohnson.com/Building-Automation-Systems-Michigan/Clawson-Michigan/Building-Automation-System-Clawson-Manor.html; retrieved from the internet Oct. 27, 2022 (3 pages).
Johnson Heating and Cooling, LLC, "Building Automation System in Michigan Images," URL: http://cooljohnson.com/Building-Automation-Systems-Michigan/Macomb-County-Michigan/Building-Automation-Images.html; retrieved from the internet Oct. 27, 2022 (13 pages).
Johnson Heating and Cooling, LLC, "Building Automation System in Michigan," URL: http://cooljohnson.com/Building-Automation-Systems-Michigan/Macomb-County-Michigan/Building-Automation-Confidential-Customer.html; retrieved from the internet, Oct. 27, 2022 (4 pages).
Johnson Solid State LLC, "Building Automation Equipment," URL: http://cooljohnson.com/Video/Building_Automation/Confidential_Customer_BLD_2/Building_Automation_Equipment.mp4, retrieved from internet Oct. 27, 2022 (35 pages).
Johnson Solid State LLC, "Building Automation GUI," Url: http://cooljohnson.com/Video/Building_Automation/Confidential_Customer_BLD_2/Building_Automation_GUI.mp4, retrieved from internet Oct. 27, 2022 (24 pages).
Johnson Solid State LLC, "Cooling Logic Overview," URL: http://coolinglogic.com/documents/CoolingLogic_Overview_High_Quality.mp4, retrieved from internet Oct. 27, 2022 (16 pages).
Johnson Solid State LLC, "So what is CoolingLogic™?" URL: http://coolinglogic.com/Coolinglogic-How-it-Works.html, retrieved from the internet Oct. 27, 2022 (3 pages).
Johnson, David, "A Method to Increase HVAC System Efficiency And Decrease Energy Consumption," White Paper: Johnson Solid State, LLC, URL: http://coolinglogic.com/documents/16102106_White_Paper_High_Resolution_Protected.pdf, Sep. 24, 2016 (51 pages).
Johnson, David, "CoolingLogic™: Mosaic Christian Church A Case Study," Report: Johnson Solid State, LLC, URL: http://coolinglogic.com/documents/19020301_Mosaic_Christian_Coolinglogic_Case_Study.pdf, Feb. 2, 2019 (140 pages).
Johnson, David, "Excel Rehabilitation Building Automation: Building Automation System User Manual ," URL: http://cooljohnson.com/Building-Automation-Systems-Michigan/Waterford-Michigan/Building-Automation-System-Excel-Manual.html, 2012 (10 pages).
Johnson, David, "Temperature Control System and Methods for Operating Same," Pre-Publication printout of U.S. Appl. No. 15/231,943, filed Aug. 9, 2016, URL: http://coolinglogic.com/documents/16080901_CIP_As_Filed.pdf (99 pages).
Johnson, David., "CoolingLogic™: Changing the Way You Cool," Report: Johnson Solid State, LLC, URL: http://coolinglogic.com/documents/18111303_Changing_the_way_you_Cool.pdf, Nov. 7, 2018 (12 pages).

* cited by examiner

INTEGRATED ZONE CONTROL SYSTEM

CROSS REFERENCE TO RELATED APPLICATIONS

This is a continuation application of U.S. patent application Ser. No. 16/253,070, entitled "INTEGRATED ZONE CONTROL SYSTEM," filed Jan. 21, 2019, which claims priority from and the benefit of U.S. Provisional Application Ser. No. 62/789,852, entitled "INTEGRATED ZONE CONTROL SYSTEM," filed Jan. 8, 2019, each of which is hereby incorporated by reference in its entirety for all purposes.

BACKGROUND

The present disclosure relates generally to a heating, ventilation, and/or air conditioning (HVAC) system, and more particularly, to an integrated zone control system for an HVAC system.

HVAC systems are utilized in residential, commercial, and industrial environments to control environmental properties, such as temperature and humidity, for occupants of the respective environments. The HVAC system may control the environmental properties through control of an airflow delivered to the environment. In some cases, HVAC systems may be configured to independently condition various zones within a structure. For example, a structure may be separated into a plurality of zones, where a flow of conditioned air into an individual zone is controlled by a respective damper of the individual zone. In some cases, a zone controller may be utilized to adjust a position of the respective damper associated with the zone based on feedback from a zone thermostat, for example. Unfortunately, existing control systems incorporate a zone panel that is connected to the zone controller, each zone thermostat, and each damper, which may increase costs and increase a complexity of installation of the control system.

DRAWINGS

SUMMARY

Figure 1:
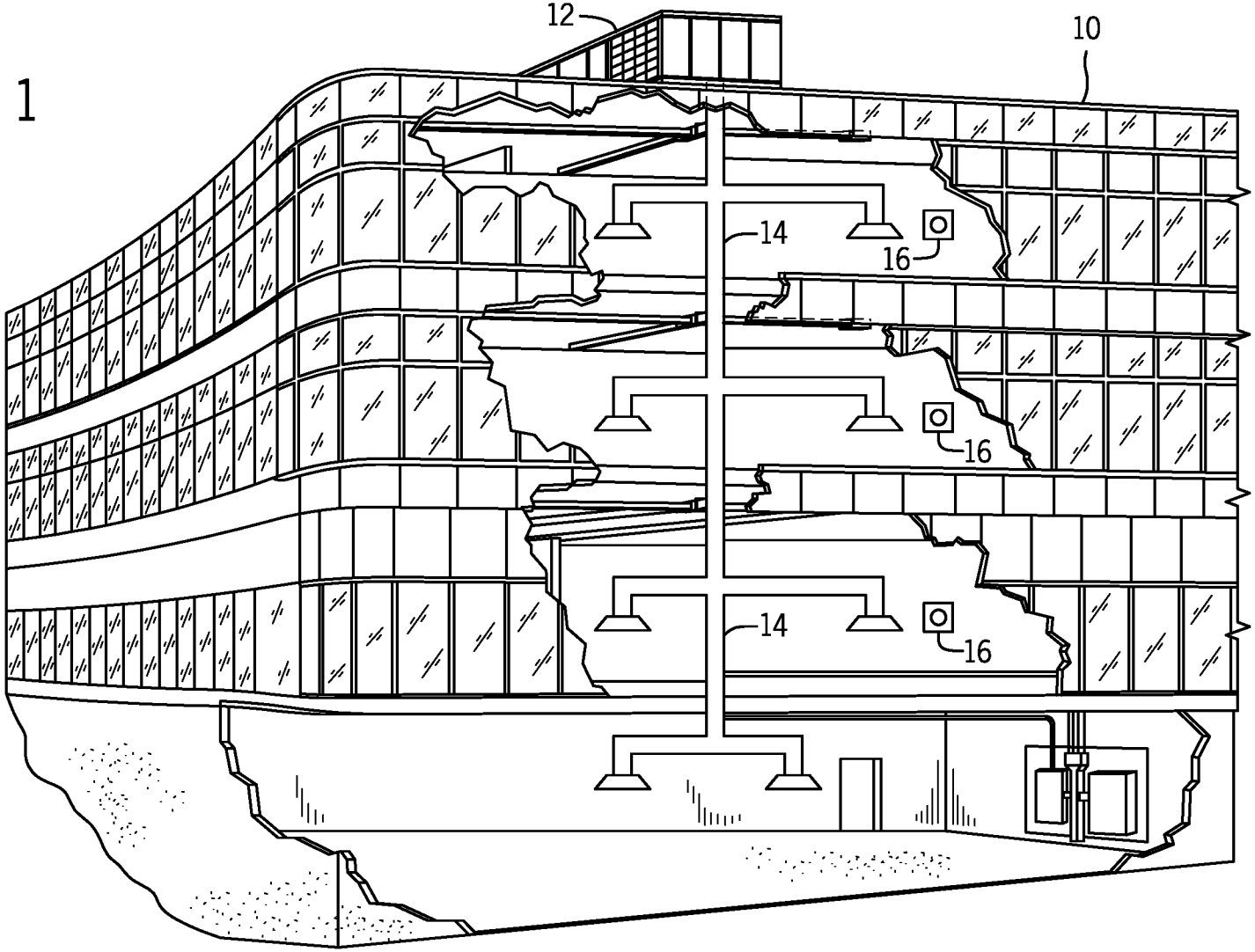
FIG. 1 is a schematic of an embodiment of an HVAC system for building environmental management that includes an HVAC unit, in accordance with an aspect of the present disclosure.

In one embodiment of the present disclosure, a zoning system for a heating, ventilation, and/or air conditioning (HVAC) system includes a temperature control device configured to monitor a temperature in a zone of a structure for conditioning by the HVAC system and configured to send a wireless control signal including data based on the temperature, and a damper actuator configured to be associated with the zone and configured to adjust a position of a damper to control an airflow into the zone, where the damper actuator is configured to receive the wireless control signal from the temperature control device and configured to adjust the position of the damper based on the data.

In another embodiment of the present disclosure, a zoning system for a heating, ventilation, and/or air conditioning (HVAC) system includes a plurality of temperature control devices disposed in respective zones of a plurality of zones of a structure for conditioning by the HVAC system, where a temperature control device of the plurality of temperature control devices is disposed within a first zone of the plurality of zones and is configured to monitor a temperature in the first zone of the plurality of zones, a damper assembly having a damper and a damper actuator, where the damper assembly is configured to be associated with the first zone of the plurality of zones, where the damper assembly is configured to be in wireless communication with the temperature control device, where the temperature control device is configured to send a wireless signal to the damper assembly, and where the damper is assembly is configured to control the damper actuator to adjust a position of the damper to control an air flow into the first zone of the structure based on the temperature, and a master temperature control device of the plurality of temperature control devices disposed in a second zone of the plurality of zones, where the master temperature control device is configured to be in wireless communication with the temperature control device and the damper assembly.

In a further embodiment of the present disclosure, a zoning system for a heating, ventilation, and/or air conditioning (HVAC) system includes a damper assembly including a damper and a damper actuator, where the damper assembly is configured to be associated with a first zone of a structure to be conditioned by the HVAC system, the damper assembly is configured to be in wireless communication with a zone temperature control device associated with the first zone of the structure and with a master temperature control device associated with a second zone of the structure, the damper assembly is configured to receive a wireless signal from the zone temperature control device, the master temperature control device, or both, and the damper actuator is configured to adjust a position of the damper to control an air flow into the first zone of the structure based on the wireless signal.

Other features and advantages of the present application will be apparent from the following, more detailed description of the embodiments, taken in conjunction with the accompanying drawings which illustrate, by way of example, the principles of the application.

DETAILED DESCRIPTION

The present disclosure is directed to an integrated zone control system that may reduce an amount of hardware included in a zoned heating, ventilation, and/or air conditioning (HVAC) system. As set forth above, existing zone control systems may include a zone panel that may be connected, via wires, to a zone controller, zone thermostats associated with individual zones to be conditioned by the HVAC system, and damper actuators that adjust a position of a damper to control a flow of conditioned air into the individual zones Wiring the zone panel to the zone controller, each of the zone thermostats, as well as the damper actuators for each zone increases a cost of the zoned HVAC system. Moreover, coupling each component to the zone panel may be time consuming and complex. As such, it is now recognized that an integrated zone control system may reduce costs and reduce installation times for zoned HVAC systems.

Accordingly, embodiments of the present disclosure are directed to an integrated zone control system that includes a main temperature control device, or a main thermostat, that is configured to be communicatively coupled to wireless damper actuators associated with respective zones to be conditioned by an HVAC system. Additionally, the main temperature control device may be communicatively coupled to zone temperature control devices, or zone thermostats, that monitor a temperature within the respective zones. Each zone temperature control device may be communicatively coupled to the main temperature control device and provide feedback to the main temperature control device indicative of a current temperature and/or a temperature set point within a respective zone of the zone temperature control device. Additionally, each zone temperature control device may be communicatively coupled to a respective wireless damper actuator associated with the zone in which the zone temperature control device monitors the temperature.

A zone temperature control device may be instructed by the main temperature control device to send a control signal to an associated wireless damper actuator based on feedback provided to the main temperature control device from the zone temperature control device. Additionally or alternatively, the main temperature control device may directly communicate with and actuate a respective wireless damper actuator based on the feedback received from the associated zone temperature control device. Therefore, each wireless damper actuator may be in communication with an associated zone temperature control device as well as the main temperature control device. However, in some embodiments, each wireless damper actuator may not be in communication with zone temperature control devices that are not associated with the zone of the wireless damper actuator. The main temperature control device may include a processor configured to execute instructions stored on a memory of the main temperature control device. The instructions may enable the main temperature control device to execute zone control via communication with the zone temperature control devices and/or the wireless damper actuators, which may eliminate the zone panel. The costs of the zone control system may be reduced, and installation of the zoned HVAC system may be simplified by utilizing the integrated zone control system disclosed herein.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
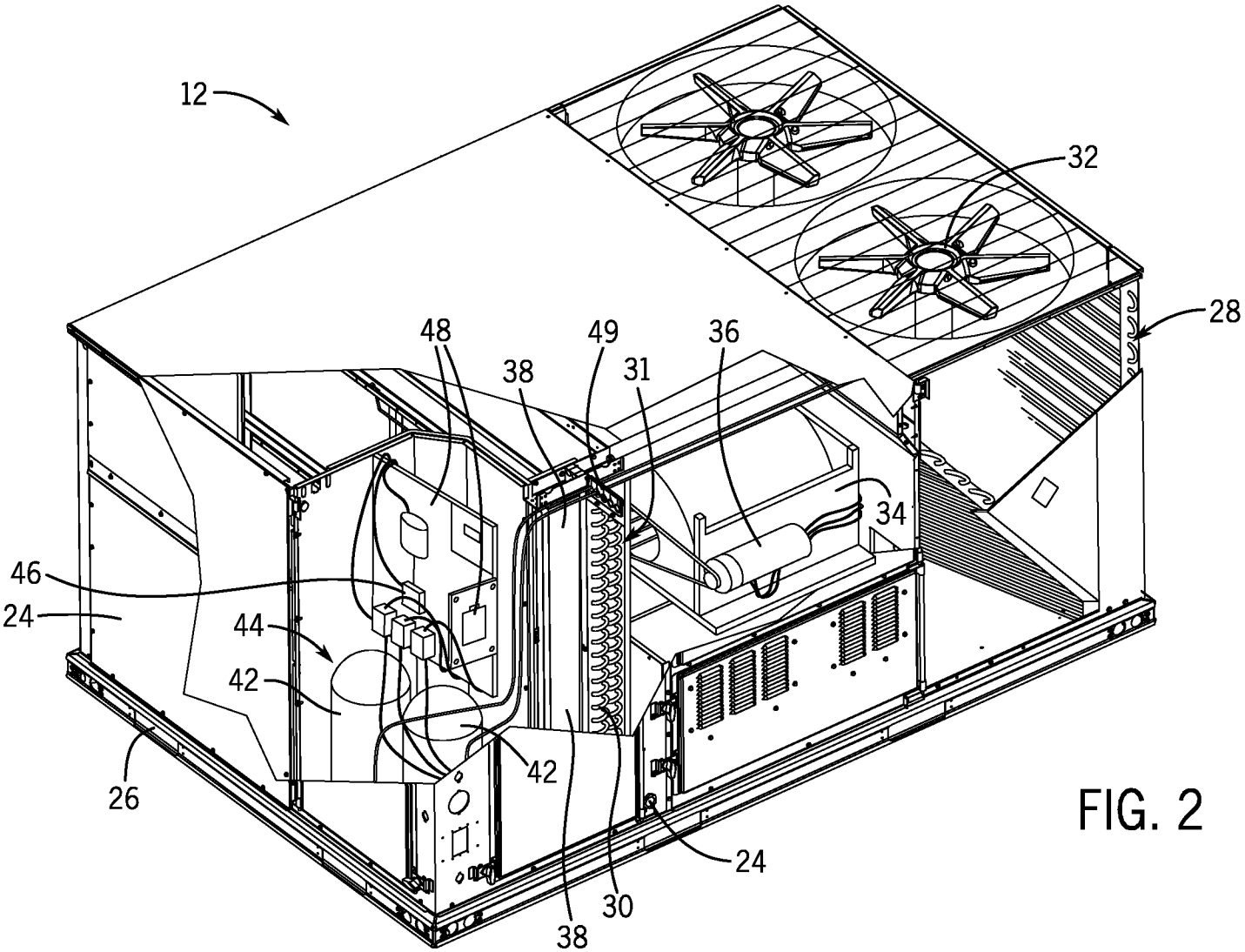
FIG. 2 is a perspective view of an embodiment of an HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
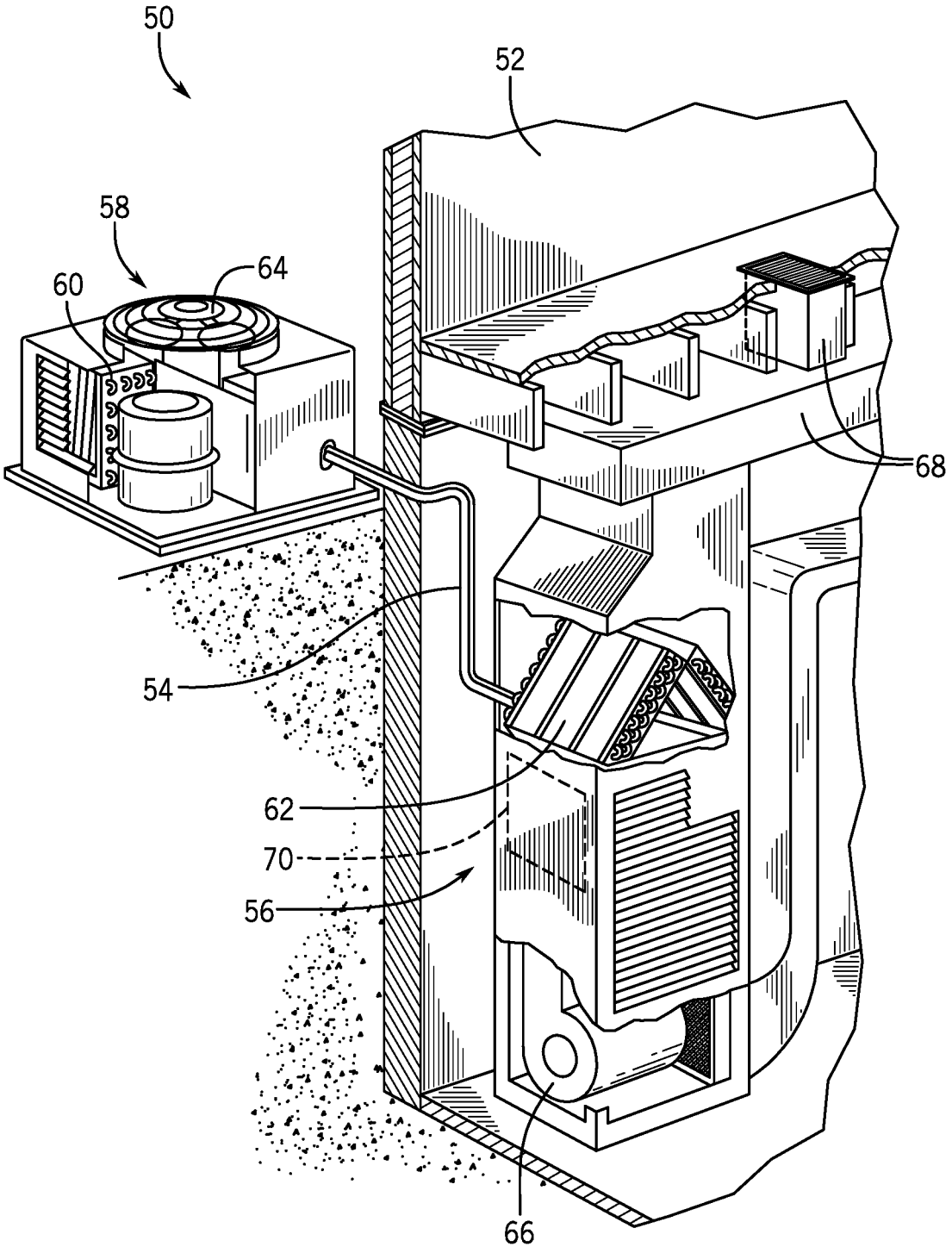
FIG. 3 is a cutaway perspective view of an embodiment of a split, residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
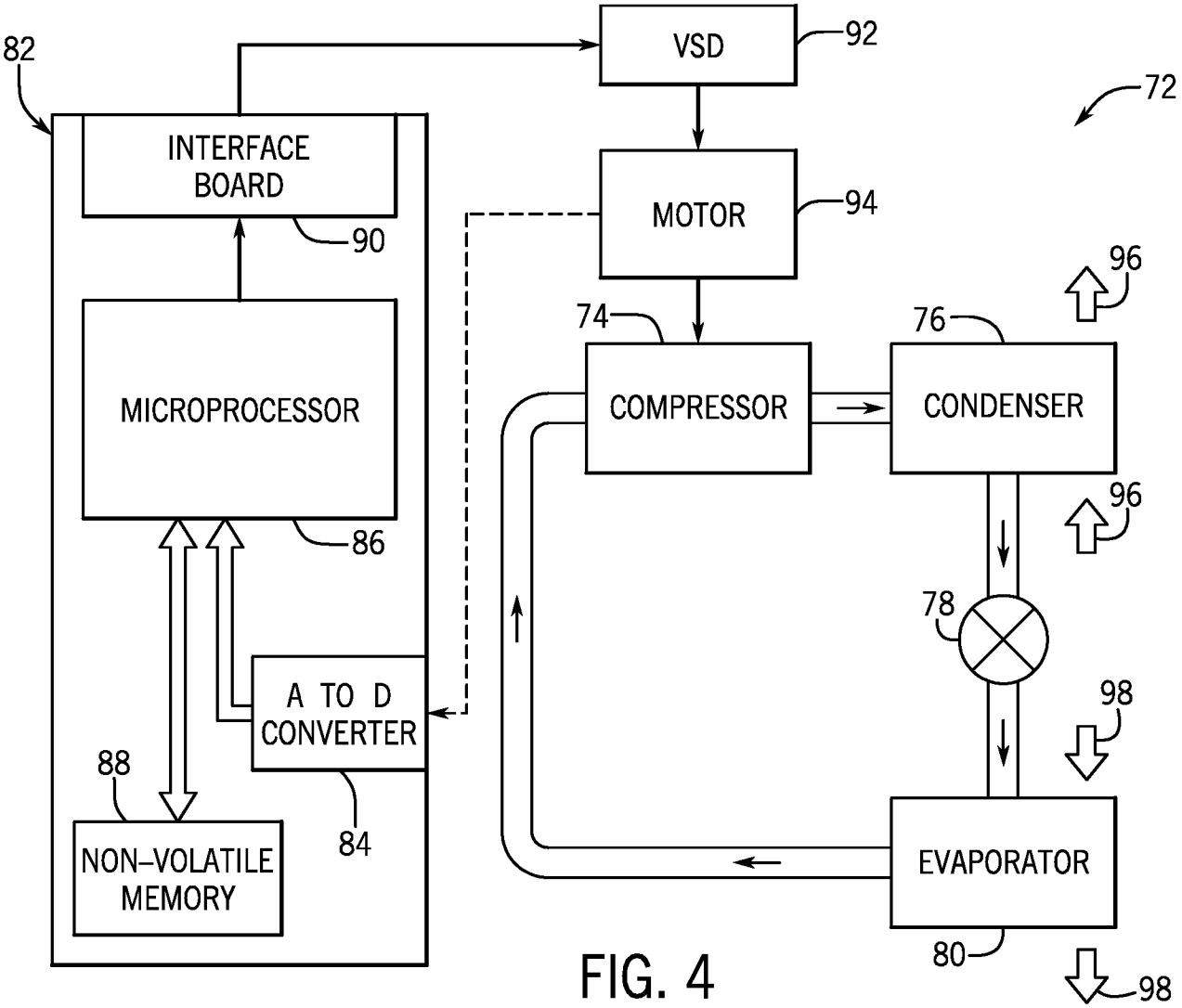
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to an integrated zone control system that eliminates a zone panel that is used in existing zone control systems. For example, in some cases, an HVAC system may condition a plurality of zones within a structure. A flow of conditioned air toward each zone may be controlled by a respective damper assembly, which may adjust a flow rate of air through a duct or vent, such as the ductwork 14, that ultimately outputs the conditioned air into the associated zone. The integrated zone control system of the present disclosure includes a master temperature control device, or a master thermostat, that is configured to be communicatively coupled to a wireless actuator of each damper assembly of each zone. For example, each zone may include an associated damper assembly, which may include a damper that is adjusted via a wireless actuator of the damper, such as a motor or other drive, to control a flow of conditioned air into the zone. As such, each wireless actuator of a damper assembly may include an identifier, a designation, and/or a tag that enables the master temperature control device to identify the respective wireless actuator and associate the respective wireless actuator with a particular zone.

Each zone may also include an associated zone temperature control device, such as a zone thermostat. Each zone temperature control device may be configured to monitor a temperature within an associated zone. The temperature within the associated zone may be communicated by the associated zone temperature control device to the master temperature control device and may be utilized as feedback by the master temperature control device in order to determine a flow rate of conditioned air toward the particular zone. In some embodiments, the master temperature control device includes a processor configured to execute instructions stored in a memory of the master temperature control device for adjusting a position of a damper. For example, the master temperature control device may send a control signal to adjust a position of a damper based on a difference between a temperature within a zone and a temperature set point of the zone.

As such, each zone temperature control device is communicatively coupled with the master temperature control device to provide feedback indicative of the temperature within the associated zone, as well as the temperature set point within that zone. The master temperature control device may then send a signal to the respective wireless actuator of the damper assembly associated with the particular zone or send a signal back to the zone temperature control device to instruct the zone temperature control device to adjust the respective wireless actuator. The wireless actuators of the damper assemblies may each be in wireless communication with the master temperature control device as well as the associated zone temperature control device of the particular zone in which the damper assembly is configured to condition. However, in some embodiments, the damper assemblies are not in wireless communication with zone temperature control devices that not associated with the zone of a respective damper assembly. By including the zoning instructions and programming within memory of the master temperature control device, a zone panel may be eliminated, thereby reducing costs and installation times of the zoned HVAC system.

Figure 5:
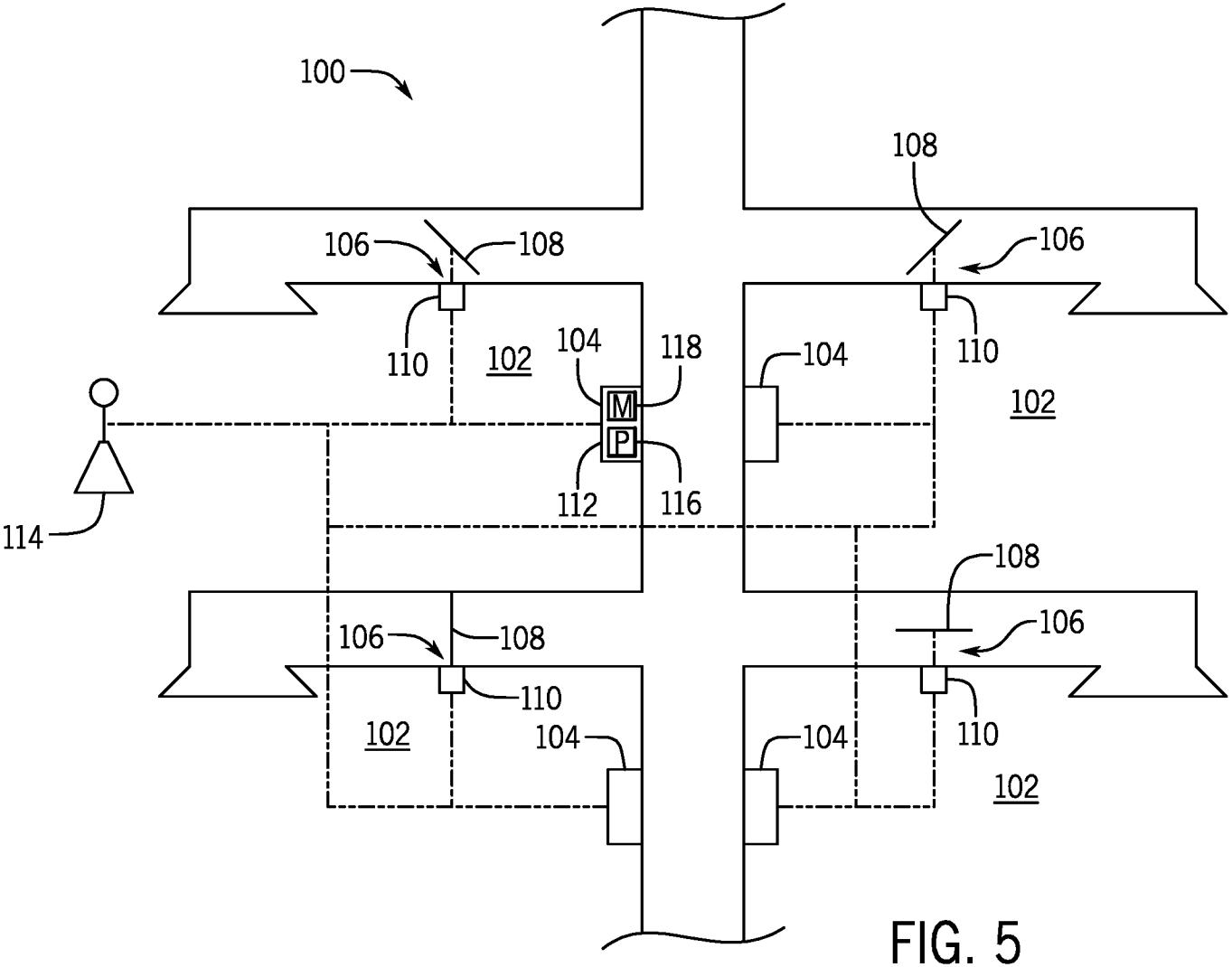
FIG. 5 is a schematic diagram of an embodiment of a structure having an integrated zone control system, in accordance with an aspect of the present disclosure.

For example, FIG. 5 is a schematic diagram of an embodiment of an integrated zone control system 100. As shown in the illustrated embodiment of FIG. 5, a structure, such as the building 10, includes a plurality of zones 102 that are configured to be conditioned by the HVAC unit 12 and/or the residential heating and cooling system 50 described above or another HVAC system. Each zone 102 may include a corresponding zone temperature control device 104, or zone thermostat, as well as a corresponding damper assembly 106. Each damper assembly 106 may include a damper 108 and a damper actuator 110, such as a wireless damper actuator. In some embodiments, the zone temperature control devices 104 are communicatively coupled to a master temperature control device 112 via a network 114. As shown in the illustrated embodiment, the master temperature control device 112 may also be the zone temperature control device 104 for one of the zones 102. For example, the master temperature control device 112 may be located in a respective zone 102 that is utilized or occupied most frequently by an owner of the building 10. In other embodiments, the master temperature control device 112 may be positioned within the respective zone 102 that is installed first or before the remaining zone temperature control devices 104. In still further embodiments, the master temperature control device 112 may be positioned within any of the zones 102.

In some embodiments, each damper actuator 110 of a particular zone 102 is communicatively coupled to a corresponding zone temperature control device 104 and to the master temperature control device 112 via the network 114. Additionally, or alternatively, each damper actuator 110 may not be in communication with zone temperature control devices 104 of zones 102 that are outside of the particular zone 102 with which the damper actuator 110 is associated. Therefore, a signal configured to be sent to a first damper actuator 110 may not be inadvertently sent to a second damper actuator 110.

Further still, the master temperature control device 112 may include a processor 116 and memory 118. The memory 118 may be a mass storage device, a flash memory device, removable memory, or any other non-transitory computer-readable medium that includes instructions. The memory 118 may also include volatile memory such as randomly accessible memory (RAM) and/or non-volatile memory such as hard disc memory, flash memory, and/or other suitable memory formats. The processor 116 may execute instructions stored in the memory 118, such as instructions to send and receive communications to and from the zone temperature control devices 104 and/or the damper actuators 110. In some embodiments, each damper actuator 110 may include an identifier associated with the respective damper actuator 110. For example, the identifier may include a name, a code, a number, a dual in-line package (DIP) switch setting, and/or another suitable identifier that enables the master temperature control device 112 to actuate a selected damper actuator 110.

Figure 6:
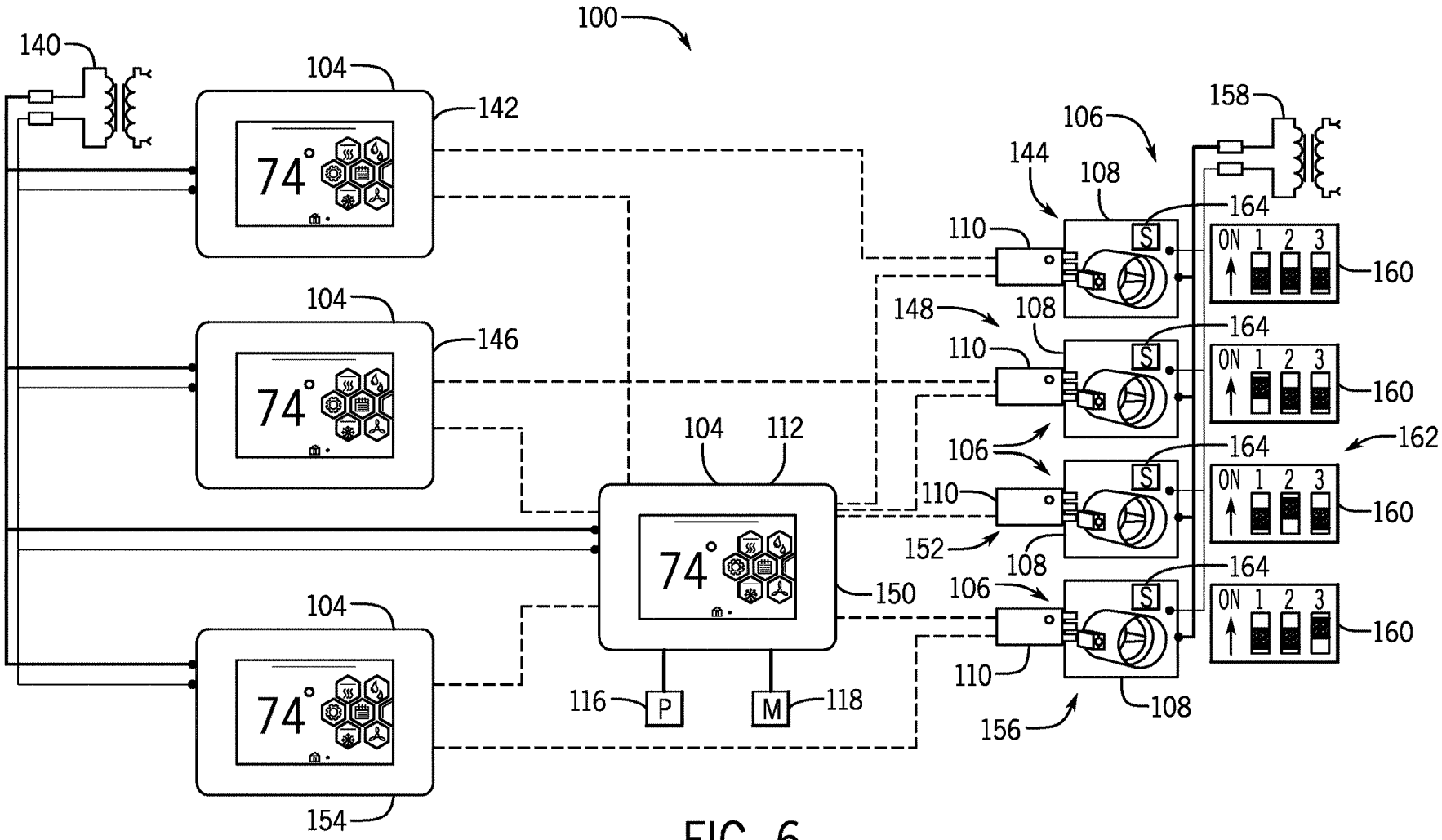
FIG. 6 is a schematic diagram of an embodiment of the integrated zone control system, in accordance with an aspect of the present disclosure.

For instance, FIG. 6 is a schematic diagram of an embodiment of the integrated zone control system 100, illustrating the communication between various damper assemblies 106 and the corresponding or associated zone temperature control devices 104. As shown in the illustrated embodiment of FIG. 6, each of the zone temperature control devices 104 are electrically coupled to a power supply 140, such as a first power supply. The power supply 140 may be a common power supply that provides electrical power to each of the zone temperature control devices 104, such as via a wired connection. In other embodiments, the power supply 140 may include a plurality of units, where each unit is configured to provide a separate supply of electrical power to a respective zone temperature control device 104. In any case, the electrical power supplied to the zone temperature control devices 104 may enable the zone temperature control devices 104 to establish wireless communication with associated damper assemblies 106 via the network 114.

In some embodiments, each zone temperature control device 104 may be communicatively coupled to a single, corresponding damper assembly 106 of a particular zone 102, with which the zone temperature control device 104 and the single, corresponding damper assembly 106 are associated. For instance, the illustrated embodiment of FIG. 6 shows four of the zone temperature control devices 104 and four corresponding damper assemblies 106. As such, a first zone temperature control device 142 is communicatively coupled to a first damper assembly 144, a second zone temperature control device 146 is communicatively coupled to a second damper assembly 148, a third zone temperature control device 150 is communicatively coupled to a third damper assembly 152, and a fourth zone temperature control device 154 is communicatively coupled to a fourth damper assembly 156. While the illustrated embodiment of FIG. 6 shows the integrated zone control system 100 having four zone temperature control devices 104 and four corresponding damper assemblies 106, in other embodiments, the integrated zone control system 100 may include one, two, three, five, six, seven, eight, nine, ten, or more than ten of the zone temperature control devices 104 and a corresponding number of damper assemblies 106. In still further embodiments, each zone 102 may include multiple damper assemblies 106 with a single zone temperature control device 104. As such, a number of zone temperature control devices 104 and a number of damper assemblies 106 included in the integrated zone control system 100 may not be equal.

As shown in the illustrated embodiment of FIG. 6, the damper assemblies 106 may also be electrically coupled to a power supply 158, such as a second power supply. The power supply 158 may be a common power supply that provides electrical power to each of the damper assemblies 106, such as via a wired connection. In other embodiments, the power supply 158 may include a plurality of units, where each unit is configured to provide a separate supply of electrical power to a respective damper assembly 106. In any case, the electrical power supplied to the damper assemblies 106 may enable the damper assemblies 106 to establish a wireless connection with respective zone temperature control devices 104, as well as enable the damper actuators 110 to adjust a position of the respective dampers 108. In some embodiments, the power supplies 140, 158 may include a battery, a generator, an electrical outlet electrically coupled to a utility power grid, or another suitable power supply that may generate or otherwise supply electrical power to the zone temperature control devices 104 and/or the damper assemblies 106. Additionally or alternatively, the power supplies 140, 158 may be the same, such that the zone temperature control devices 104 and the damper assemblies 106 receive power from the same source.

As set forth above, each of the damper assemblies 106, and specifically, the damper actuators 110, may include an identifier 160 that is specific and/or unique to a particular damper assembly 106. For example, in some embodiments, the identifier 160 may include a setting on a DIP switch 162 corresponding to a particular damper assembly 106. As should be understood, the DIP switch 162 may include a plurality of ports that may electrically couple leads of the damper assemblies 106 to a power supply, such as the power supply 158. Further, the DIP switch 162 includes a plurality of switches that form an electrical connection between the power supply 158 and a lead disposed within an associated port of the switch. As such, turning various switches of the DIP switch 162 on or off may forms a specific pattern of the DIP switch 162, which creates the identifier 160 of a particular damper assembly 106 or particular damper assemblies 106, such as all of the damper assemblies 106 associated with a particular zone 102. When the particular pattern is formed on the DIP switch 162, power may be supplied to the particular damper assembly 106 or damper assemblies 106 associated with the particular pattern, and the damper actuator 110 may adjust a position of the damper 108.

As set forth above, the zone temperature control system 100 also includes the master temperature control device 112. The master temperature control device 112 may include the processor 116 and the memory 118 that enable the master temperature control device 112 to control a flow of conditioned air toward each zone 102 of the plurality of zones 102. The master temperature control device 112 may directly communicate with each of the damper assemblies 106, such as each of the damper actuators 110, based on feedback received from the zone temperature control devices 104. Accordingly, each zone temperature control device 104 of the plurality of zone temperature control devices 104 may provide feedback to the master temperature control device 112 indicative of a current temperature within an associated zone 102 of the zone temperature control device 104. Additionally, each zone temperature control device 104 of the plurality of zone temperature control devices 104 may provide feedback to the master temperature control device 112 indicative of a target temperature or temperature set point of the associated zone 102 of the zone temperature control device 104. The master temperature control device 112 may then compare the feedback indicative of the current temperature within a respective zone 102 to the temperature set point of the respective zone 102.

Based on the comparison of the feedback, the master temperature control device 112 may send a control signal to a respective damper assembly 106, such that a position of the damper 108 is adjusted by the damper actuator 110 of the respective damper assembly 106. In some embodiments, the control signal is directed toward the DIP switch 162 and includes the identifier 160 of the respective damper assembly 106 to be adjusted. Accordingly, the control signal may actuate the DIP switch 162 to supply power to the respective damper assembly 106 and enable a position of the damper 108 to be adjusted by the damper actuator 110. In some embodiments, the master temperature control device 112 may send the control signal to the respective damper assembly 106 and/or the DIP switch 162 when the comparison of the feedback from the zone temperature control device 104 associated with the respective damper assembly 106 indicates that a difference between the current temperature and the temperature set point of the associated zone 102 is above a threshold amount. Accordingly, a position of the damper 108 within the associated zone 102 may be adjusted to control a flow of air into the associated zone 102. Sending the control signal to the damper assembly 106 of the associated zone 102 may enable the current temperature within the associated zone 102 to approach the temperature set point of the associated zone 102.

In other embodiments, instead of sending the control signal directly to the damper assemblies 106, the master temperature control device 112 may send a control signal back to the zone temperature control device 104 providing feedback indicative of a difference between the current temperature and the temperature set point exceeding the threshold amount. As such, the zone temperature control device 104 may send the control signal, or a supplemental control signal, toward the damper assembly 106 associated with the respective zone 102 of the zone temperature control device 104. In some cases, utilizing the individual zone temperature control devices 104 to send the signals may avoid utilizing the identifiers 160 because the zone temperature control devices 104 may be communicatively coupled only with damper assemblies 106 associated with the zone 102 of the zone temperature control device 104 and not with damper assemblies 106 associated with other zones 102.

In any case, the master temperature control device 112 may include programming for determining whether to actuate a damper assembly 106 associated with any zone 102 of the plurality of zones 102. Therefore, the individual zone temperature control devices 104 are not communicatively coupled to a zone panel and do not include superfluous programming or software already included in the master temperature control device 112. As such, the integrated zone control system 100 may reduce costs of the zoned HVAC system. As set forth above, in some embodiments, the master temperature control device 112 may be one of the zone temperature control devices 104, and thus monitor a current temperature and receive an input indicative of a temperature set point for an associated zone 102, in addition to performing the zone control over each of the other zones 102. In other embodiments, the master temperature control device 112 may be a separate unit that is communicatively coupled to each zone temperature control device 104 of the plurality of zone temperature control devices 104.

It should be noted that, by establishing a wireless connection between the zone damper assemblies 106 and the zone temperature control devices 104, the integrated zone control system 100 may utilize damper actuators 110 that include multiple configurations. For example, in some cases, damper actuators 110 may include varying numbers of wires that establish a communication between the damper actuators 110 and the zone temperature control devices 104. By enabling a wireless connection between the damper actuators 110 and the zone temperature control devices 104, the damper actuators 110 may include any suitable configuration, such as two-wire damper actuators 110 and/or three-wire damper actuators. Further, in some embodiments, the dampers 108 of the damper assemblies 106 may be normally-closed dampers. In other words, the dampers 108 are biased toward a closed position. Upon receiving a supply of electrical power, such as from the power source 158, the damper actuators 110 may adjust a position of the dampers 108 toward an open position to enable air to flow into the zone 102 associated with the particular damper assembly 106. In other embodiments, the dampers 108 may be normally-open, such that the supply of electrical power may cause the damper actuator 110 to adjust a position of the damper 108 toward a closed position to block the air from flowing into the zone 102 associated with the damper assembly 106.

Additionally or alternatively, the damper assemblies 106 may include a position sensor 164 that may provide feedback to the associated zone temperature control device 104 and/or the master temperature control device 112 indicative of a position of the corresponding damper 108. The position sensor 164 may enable accurate control of a position of the dampers 108, which may include intermediate positions between a fully open position and a fully closed position. The position sensor 164 may thus enhance temperature control within each of the zones 102.

Figure 7:
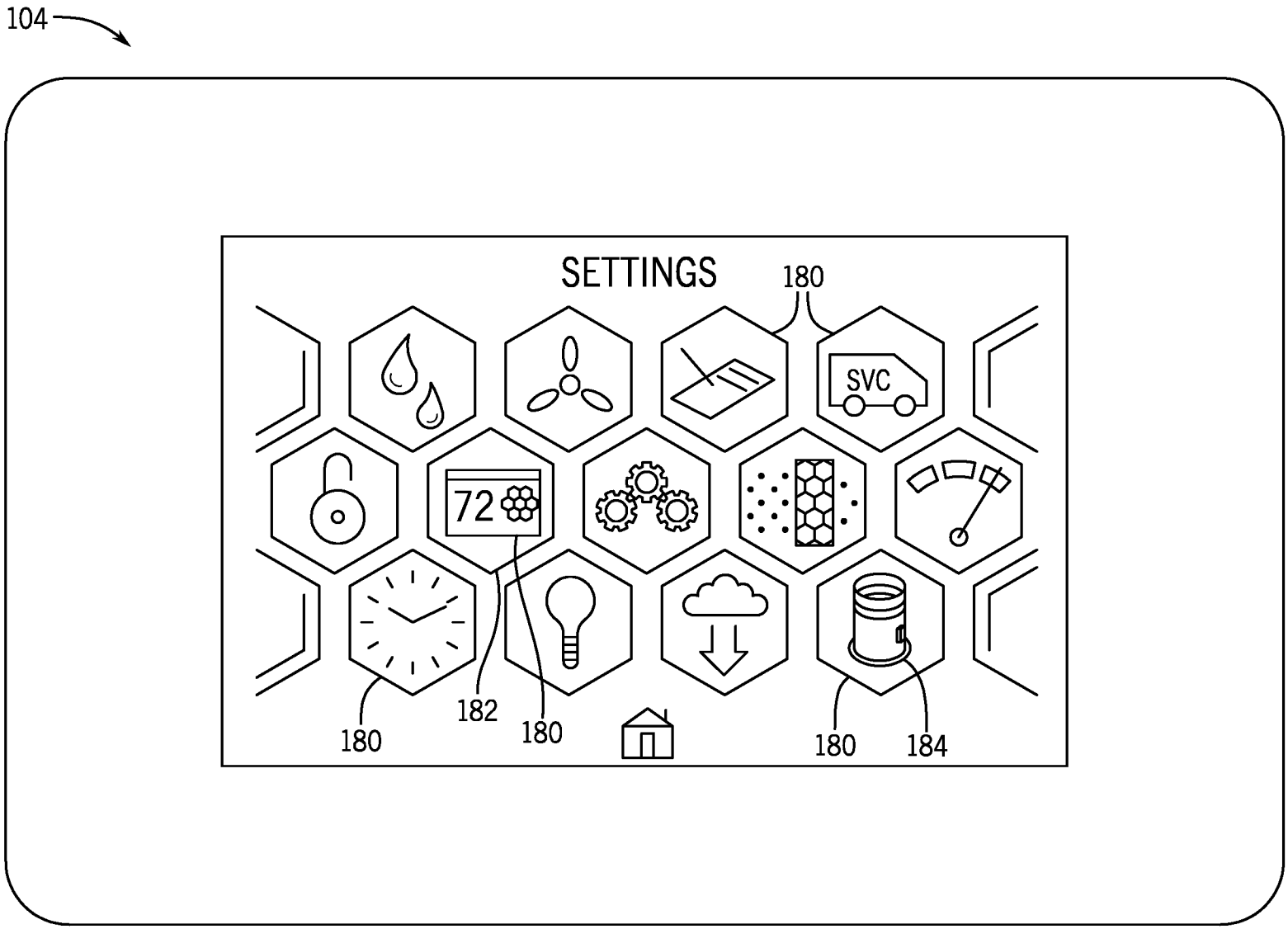
FIG. 7 is a schematic diagram of an embodiment of a zone temperature control device of the integrated zone control system, in accordance with an aspect of the present disclosure.

FIG. 7 is a schematic of an embodiment of a zone temperature control device 104 of the plurality of zone temperature control devices 104. As shown in the illustrated embodiment of FIG. 7, the zone temperature control device 104 includes a plurality of icons 180 that may be utilized for controlling various functions of the HVAC unit 12, the residential heating and cooling system 50, and/or another HVAC system. In particular, the zone temperature control device 104 includes a temperature setting icon 182 and a zoning icon 184. In some embodiments, the temperature setting icon 182 enables a user to set the temperature set point within the zone 102 associated with the zone temperature control device 104. Further, the user may utilize the temperature setting icon 182 to set or otherwise establish a schedule that adjusts a value of the temperature set point based on a time of day, a time of week, a time of month, and/or a time of year. The zoning icon 184 may enable the user to determine a status, a position, and/or other suitable information related to the damper 108 and/or damper actuator 110 associated with the zone 102 of the zone temperature control device 104.

In some embodiments, the zone temperature control device 104 may also serve or function as the master temperature control device 112. Accordingly, the user may utilize the zoning icon 184 to set up and/or control other zones 102 of the plurality of zones 102 that are not necessarily associated with the zone 102 in which the master temperature control device 112 also functions as the zone temperature control device 104. For example, the user may utilize the zoning icon 184 to input the identifier 160 of a damper assembly 106 of a new zone 102 and/or establish a communication between the master temperature control device 112 and a zone temperature control device 104 of a new zone 102. In some embodiments, the master temperature control device 112 may be configured to control any suitable number of zones 102 and may facilitate addition and/or removal of zones 102.

Figure 8:
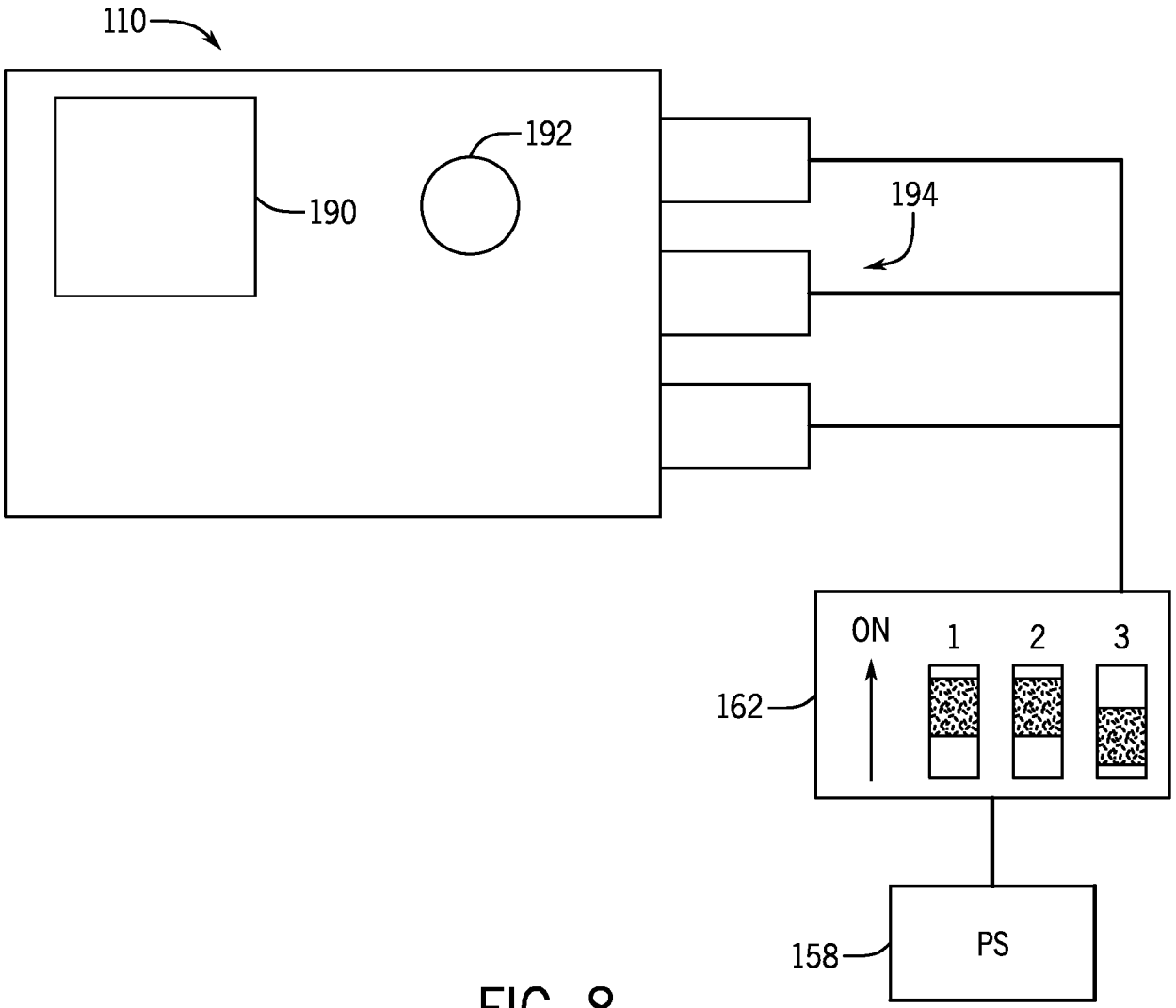
FIG. 8 is a schematic diagram of an embodiment of a damper actuator of the integrated zone control system, in accordance with an aspect of the present disclosure.

FIG. 8 is a schematic of an embodiment of the damper actuator 110. In some embodiments, the damper actuator 110 includes a wireless communication device 190, a visual indicator 192, and an electrical interface 194. The wireless communication device 190 may be configured to establish a connection with the associated zone temperature control device 104 and/or the master temperature control device 112 via Wi-Fi, near field communication, infrared communication, Bluetooth, Zigbee, or another suitable wireless communication network. Further, the visual indicator 192 may include a light emitting diode (LED) that is configured to illuminate upon a successful connection with the associated zone temperature control device 104, upon a successful connection with the master temperature control device 112, upon receiving power from the power supply 158, and/or to indicate an otherwise improper connection or communication with the associated zone temperature control device 104, the master temperature control device 112, and/or the power supply 158.

In some embodiments, the damper actuator 110 may be electrically coupled to the power supply 158 via the DIP switch 162, which may enable the damper actuator 110 to be selectively actuated. In other words, the DIP switch 162 may be in communication with the master temperature control device 112 via the wireless communication device 190. As such, the wireless communication device 190 may be activated via the control signal from the master temperature control device 112 and subsequently actuate the DIP switch 162 to enable electric power to be supplied to the damper actuator 110. In other embodiments, the DIP switch 162 may include or otherwise be communicatively coupled to a separate wireless communication device that enables the switches of the DIP switch 162 to be actuated by the master temperature control device 112. In any case, the electrical interface 194 may electrically couple the damper actuator 110 to the DIP switch 162, and thus, to the power source 158. The DIP switch 162 may then be actuated based on the indicator associated with the damper assembly 106 to supply power to the damper actuator 110. The damper actuator 110 may then adjust a position of the associated damper 108 to control a flow of air into the zone 102 in which the damper actuator 110 is associated.

As set forth above, embodiments of the present disclosure may provide one or more technical effects useful in facilitating assembly of a zoned HVAC system. For example, embodiments of the present disclosure are directed to an integrated zone control system for an HVAC system. Specifically, the integrated zone control system includes a plurality of zone temperature control devices, where each zone temperature control device of the plurality of zone temperature control devices is associated with a respective zone of a building or structure. Each zone temperature control device may also be in wireless communication with a respective damper assembly that is also associated with the zone of the zone temperature control device. Further still, a master temperature control device may receive feedback from the plurality of zone temperature control devices in order to instruct the damper assemblies to adjust a flow of air into the associated zone under certain conditions. In some embodiments, the master temperature control device may send control signals directly to the damper assemblies, and in other embodiments, the master temperature control device may communicate with the damper assemblies indirectly via the plurality of zone temperature control devices. In any case, the integrated zone control system reduces an amount of components to be installed in a zoned system and reduces a complexity of assembling the zoned system. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) system, comprising:

a control system configured to monitor an environmental parameter in a space serviced by the HVAC system and send a wireless signal including data based on the environmental parameter, wherein the control system comprises:

a first control device configured to monitor the environmental parameter in the space and send the wireless signal including the data based on the environmental parameter; and a second control device configured to:

receive the wireless signal including the data based on the environmental parameter; and based on the wireless signal, generate an additional wireless signal comprising instructions to adjust a damper; and a damper assembly comprising the damper configured to control an air flow directed into the space, wherein the damper assembly is configured to receive the additional wireless signal from the control system and adjust the damper based on the instructions.

2. The HVAC system of claim 1, wherein the control system comprises a temperature control device configured to monitor a temperature within the space, wherein the environmental parameter comprises the temperature.

3. The HVAC system of claim 1, comprising a first power source configured to supply electrical power to the control system and a second power source configured to supply electrical power to a damper actuator of the damper assembly, wherein the first power source and the second power source are different.

4. The HVAC system of claim 3, wherein the first power source is a battery.

5. The HVAC system of claim 4, wherein the second power source is a utility power grid.

6. The HVAC system of claim 1, wherein the damper assembly comprises a wireless communication device configured to establish a wireless connection with the control system via a network.

7. The HVAC system of claim 6, wherein the damper assembly comprises a visual indicator configured to indicate establishment of the wireless connection between the control system and the wireless communication device.

8. The HVAC system of claim 7, wherein the visual indicator comprises a light emitting diode (LED) configured to illuminate to indicate the establishment of the wireless connection between the control system and the wireless communication device.

9. The HVAC system of claim 1, wherein the second control device is configured to generate the additional wireless signal based on comparison of a current value of the environmental parameter within the space with a target set point of the environmental parameter.

10. The HVAC system of claim 1, wherein the first control device is a thermostat positioned within the space, and the second control device is a master temperature control device configured to be disposed within an additional space serviced by the HVAC system and monitor a temperature within the additional space.

* * * * *